US006564032B2

(12) United States Patent
Hara et al.

(10) Patent No.: US 6,564,032 B2
(45) Date of Patent: May 13, 2003

(54) FIXING APPARATUS FOR FIXING POLYMERIZED TONER BY HARD ROLLER

(75) Inventors: Nobuaki Hara, Chiba (JP); Osamu Watanabe, Kanagawa (JP); Toshinori Nakayama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/941,584

(22) Filed: Aug. 30, 2001

(65) Prior Publication Data

US 2002/0051661 A1 May 2, 2002

(30) Foreign Application Priority Data

Sep. 1, 2000 (JP) ..... 2000-265294

(51) Int. Cl.[7] ..... G03G 15/20
(52) U.S. Cl. ..... 399/328; 399/333
(58) Field of Search ..... 399/328, 329, 399/324, 320; 430/97, 99, 124, 108.8; 219/216; 347/156

(56) References Cited

U.S. PATENT DOCUMENTS

| | | | | |
|---|---|---|---|---|
| 4,712,908 A | | 12/1987 | Nakayama et al. | 399/86 |
| 6,055,403 A | | 4/2000 | Watanabe | 399/328 |
| 6,070,046 A | * | 5/2000 | Maeyama | 399/328 |
| 6,131,010 A | * | 10/2000 | Kume et al. | 399/333 X |
| 6,198,901 B1 | | 3/2001 | Watanabe | 399/328 |
| 2001/0022909 A1 | * | 9/2001 | Takeuchi et al. | 399/328 |

FOREIGN PATENT DOCUMENTS

| | | | |
|---|---|---|---|
| JP | 36-10231 | | 7/1936 |
| JP | 56-13945 | | 4/1981 |
| JP | 59-53856 | | 3/1984 |
| JP | 59-61842 | | 4/1984 |
| JP | 10-221991 | * | 8/1998 |
| JP | 2001-215767 | * | 8/2001 |

* cited by examiner

*Primary Examiner*—Sophia S. Chen
(74) *Attorney, Agent, or Firm*—Fitzpatrick, Cella, Harper & Scinto

(57) ABSTRACT

A fixing apparatus that has a fixing member which makes contact with a recording material supporting an unfixed image formed of wax-containing toner on the unfixed image-supporting surface, the fixing member having a supporting material and a surface releasing layer formed on the supporting material and formed of a hard resin, and a pressing member which forms a nip which holds and conveys the recording material with the fixing member and that satisfies the following express:

$$2.0\times10^5 \leqq F/S \leqq 10.0\times10^5$$

wherein F is the pressure-contact force (N) between the fixing member and the pressing member, and S is the area ($m^2$) of the nip.

9 Claims, 4 Drawing Sheets

FIXING APPARATUS FOR FIXING POLYMERIZED TONER BY HARD ROLLER

BACKGROUND OF THE INVENTION

1. Field of the Invention

The present invention relates to a fixing apparatus which is used in an image-forming apparatus such as an electrophotographic or electrostatic-recording copying machine or printer and which fixes a toner image.

2. Related Background Art

As for an image-forming apparatus such as an electrophotographic color copying machine, active product development has heretofore been under way. As a toner used in the image-forming apparatus, a non-magnetic toner formed of a material having a lower melting point and lower melt viscosity than those of a monochrome toner is used for the purpose of improving a color-mixing property and the transparency of OHT.

Therefore, at the time of fixing a color toner image formed on a sheet of paper used as a recording material, a so-called "offset" which is the fusion of toner on the surface of a fixing roller which is the fixing member of a fixing apparatus is liable to occur. Thus, a heat-resistant silicone oil is applied as a release agent to the surface of the fixing roller in a fixing apparatus to be installed in an image-forming apparatus such as a color copying machine to prevent the offset of the toner.

Meanwhile, the fixing roller must be provided with moderate elasticity for the purpose of improving the follow-up property and fixation property to a multicolored superposed image, and it has a surface layer composed of silicone rubber having high releasability such as LTV or RTV formed on an elastic layer composed of HTV rubber or the like. This silicone rubber has a high affinity for a silicone oil because the silicone rubber is the same type of material as the silicone oil. The oil permeates the rubber through its surface to impart high releasability to the rubber and to exhibit the effect of preventing the offset.

However, the fixing apparatus provided in the conventional image-forming apparatus has the following problem.

While the fixing roller of the fixing apparatus is directly coated with the oil, a pressing roller which is pressed against and located underneath the fixing roller is often provided with the oil indirectly from the fixing roller via a nip, and the oil can be applied only at a sheet interval at the time of continuous printing. Therefore, the application of the oil to the pressing roller is liable to be intermittent, and the prevention of the offset on the pressing roller is not satisfactory accordingly. Consequently, there is the possibility that there may occur such a problem that the back of sheet is soiled by the toner stuck on the pressing roller for some reason.

The offset on the pressing roller can be prevented by applying the oil to the pressing roller directly. However, since this requires a special application mechanism, it causes such a problem that the apparatus becomes large and complicated.

It is also considered to increase the amount of the oil to be applied to the fixing roller. This is liable to cause an oil stain on a sheet, thereby degrading the quality of an image and the reliability of fixation. Further, the swelling of the fixing roller by the oil is liable to cause a change in the diameter of the roller or peeling of the rubber. To prevent these, for example, an intermediate layer having an oil-barrier function is further required, thereby complicating the constitution of the fixing roller and increasing the costs.

On the other hand, when the contact pressure of a cleaning blade is set to be small by, for example, making the entering amount of the cleaning blade to the pressing roller small so as to secure a certain amount of the oil stuck to the surface of the pressing roller during the passing of the sheets, the passing-through of the oil is liable to occur, whereby an oil blotch on a sheet may occur as in the above case.

Under the above circumstances, it has been recently found that by using toner which contains wax comprising a paraffin or a polyolefin to attain an oil-less fixing apparatus which is capable of fixing a color toner image formed on a sheet, good fixation of a color image can still be accomplished without applying a silicone oil to the fixing roller as has been conventionally practiced.

However, as the fixing roller in a fixing apparatus for fixing a color image, a so-called "soft roller" which is obtained by laminating an elastic layer comprising silicone rubber or fluororesin rubber around a core bar is used. The soft roller is also used in the currently practiced oil-less fixation.

When the soft roller is used at high temperatures of 180 to 200° C., the rubber coating layer deteriorates and is therefore liable to peel from the core bar. Thus, it has poor durability as compared with a hard roller having no elastic layer. Further, the soft roller also has the problem that the performance of the fixing roller changes between the initial stage of its use and after undergone some endurance because the hardness of the rubber changes as the rubber deteriorates. In addition, on activation of the copying machine, the fixing roller must be warmed up from room temperature to temperatures of about 160 to 200° C. at which toner can be fixed. The time during which the roller is warmed up is called "warm-up time". The shorter the time is, the more convenient it is for the user of the copying machine. However, the soft roller used in the fixing apparatus for fixing a color image also has the inconvenience that the presence of the elastic layer increases heat capacity and prolongs the warm-up time.

SUMMARY OF THE INVENTION

It is an object of the present invention to provide a fixing apparatus which is free of a mechanism for applying a releasing agent to a fixing roller.

It is another object of the present invention to provide a fixing apparatus which provides an unfixed image formed of wax-containing toner by a hard roller.

It is still another object of the present invention to provide a fixing apparatus that comprises a heat-fixing member, said heat-fixing member having a core metal and a surface releasing layer which is provided on said core metal and does not have a rubber elasticity and a pressing member which forms a nip which holds and conveys the recording material holding an unfixed image formed of wax-containing toner, wherein the unfixed image is fixed to the recording material with heat and pressure, and the following expression is satisfied:

$$2.0\times10^5 \leqq F/S \leqq 10.0\times10^5$$

wherein F is the pressure-contact force (N) between the fixing member and the pressing member, and S is the area ($m^2$) of the nip.

Other objects of the present invention will be apparent from the following description.

DETAILED DESCRIPTION OF THE PREFERRED EMBODIMENT

A description will be given to the embodiments of the present invention with reference to attached drawings.

Figure 1:
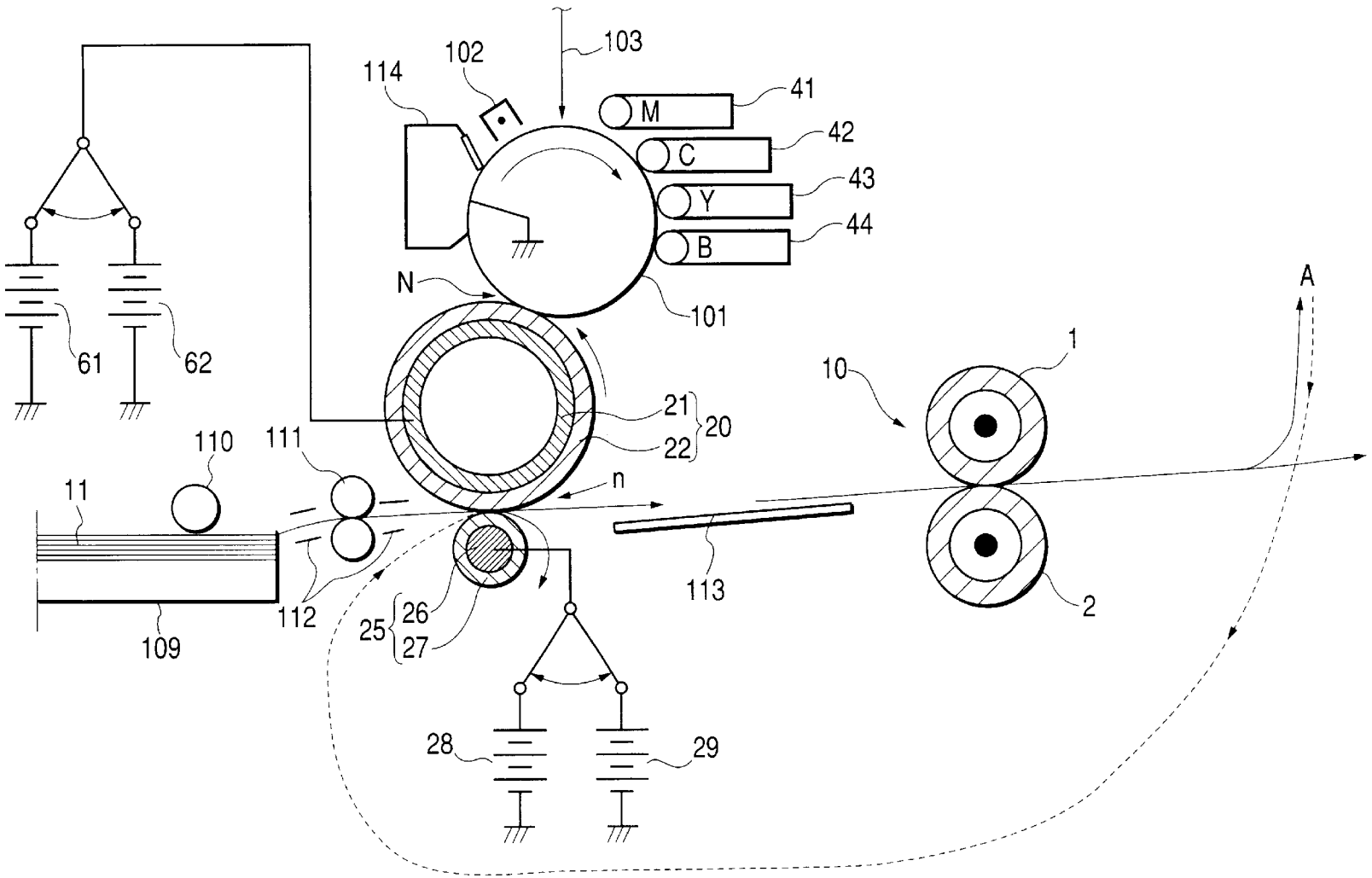
FIG. 1 is a schematic sectional diagram showing the schematic constitution of the image-forming apparatus according to the first embodiment of the present invention.

FIG. 1 is a sectional diagram showing the schematic constitution of a color image-forming apparatus which is an embodiment of the image-forming apparatus according to the present invention. In the present embodiment, a description will be given by taking a color image-forming apparatus using an intermediate transfer body as an example.

The color image-forming apparatus according to the present embodiment has, as an image holder, a photosensitive drum 101 which is driven to rotate in the direction of the arrow at a predetermined circumferential velocity, and image-forming means such as a primary electrifier 102 are placed around the photosensitive drum 101.

The photosensitive drum 101 is uniformly charged at a predetermined surface potential with predetermined polarity by the primary electrifier 102 and subjected to exposure 103 by a laser scanner (not shown) as exposure means according to image information to form an electrostatic latent image composed of a first color component such as magenta on the surface of the photosensitive drum 101. This latent image is developed by a magenta developing device 41 and visualized as a magenta toner image. The developing method is a one-component non-contact method using a non-magnetic toner as a developer, and a proper developing bias is applied between the developing sleeve of the developing device 41 and the photosensitive drum 101, whereby the non-magnetic toner on the developing sleeve flies onto the photosensitive drum 101 and sticks to the latent image to develop the image.

An intermediate transfer roller 20 as an intermediate transfer body is pressed at moderate pressure against the photosensitive drum 101. The intermediate transfer roller 20 is formed by forming an elastic non-form or form layer having medium electric resistance (volume resistivity of about $10^5$ to $10^{11}$ Ωcm) around a cylindrical core bar. To improve the releasability of the surface of the elastic layer against toner, a releasing layer composed of a fluororesin resin such as PTFE or silicone rubber and having good releasability against toner is formed on the surface of the elastic layer by tubing or coating.

The toner image on the photosensitive drum 101 is transferred onto the surface of the intermediate transfer roller 20 by applying a proper transfer bias (to a primary transfer nip N) between the intermediate transfer roller 20 and the photosensitive drum 101 from a transfer bias power source 61 (primary transfer).

After the completion of the primary transfer, the intermediate transfer roller 20 is cleaned by a cleaning device (not shown) to remove the residual of the toner used for the primary transfer from the surface of the roller 20. Thereafter, a cyan toner image as a second color (developed by a developing device 42), a yellow toner image as a third color (developing device 43) and a black toner image as a fourth color (developing device 44) are formed on the photosensitive drum 101 by performing the same procedure as described above and primary-transferred onto the intermediate transfer roller 20 so that they will be superposed on one another, whereby a superposed image of the four color toner images is formed on the intermediate transfer roller 20.

On the side of the intermediate transfer roller 20 which is opposite to the side at which the roller 20 is in contact with the photosensitive drum 101, a secondary transfer roller 25 is placed in contact with and detachably from the roller 20. The secondary transfer roller 25 is formed by forming an elastic layer 27 having medium resistance on a core bar 26.

A sheet 11 as a recording material is fed from a sheet cassette 109 to a nip (secondary transfer nip n) between the secondary transfer roller 25 and the intermediate transfer roller 20. The toner images of the four colors on the intermediate transfer roller 20 are transferred onto the sheet 11 at a time by switching a bias power source from a power source 29 to a power source 28 and applying a proper transfer bias between the intermediate transfer roller 20 and the secondary transfer roller 25 (secondary transfer). The sheet 11 is conveyed from the sheet cassette 109 by a sheet feeding roller 110 and fed to the above secondary transfer nip by resist rollers 111 and sheet feeding guides 112 placed at both sides of the rollers 111.

After the completion of the secondary transfer, the residual of the toner used for the secondary transfer is returned from the surface of the intermediate transfer roller 20 tot he photosensitive drum 101 by applying a bias whose polarity is opposite to that of the bias applied at the time of the first transfer between the intermediate transfer roller 20 and the photosensitive drum 101 from a bias power source 62 and eventually recovered by the cleaning device 114.

The sheet 11 having the toner images of the four colors transferred thereon is conveyed to a fixing apparatus 10 via a guide 113, allowed to pass through a fixing nip between a fixing roller 1 as a fixing member and a pressing roller 2 as a pressing member to mix the colors of the above toner images and to fix the toner images into the fibers of the sheet, and discharged to a sheet discharging tray.

Next, a description will be given to the toner used in the present invention.

In the present invention, sharp melt toner is used as a non-magnetic toner in a one-component developer. To state more specifically, this sharp melt toner is polymerized toner produced by a polymerization method and contains a releasing agent such as wax or paraffin which has lower melt viscosity and a lower molecular weight than those of the matrix resin of the toner. By using such a sharp melt toner produced by the polymerization method, a high color mixing property of the toner is achieved at the time of fixation, high releasability is attained by the wax oozed out of the toner by heat, and oil-less fixation is accomplished.

Figure 2:
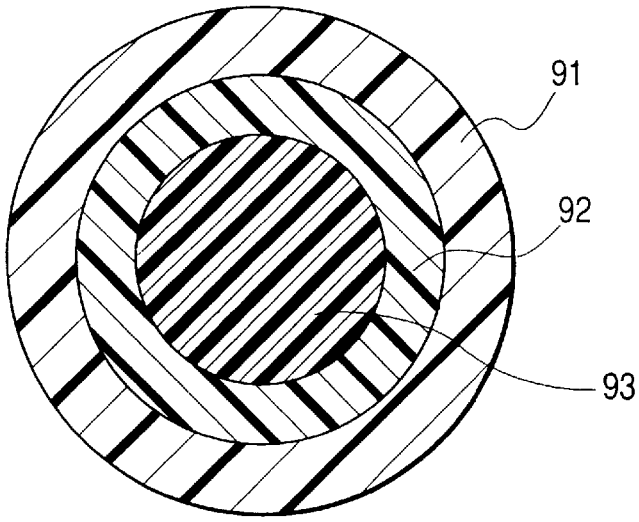
FIG. 2 is a schematic block diagram of the toner used in the image-forming apparatus of FIG. 1.

The schematic constitution of the polymerized toner is shown in FIG. 2.

The particles of the polymerized toner are spherical in shape due to the characteristic of its production method. The particle of the polymerized toner comprises a core 93, a resin layer 92 which is formed on the core 93, and a surface layer 91 which is formed on the layer 92. The core 93 contains ester-based wax therein, the resin layer 92 comprises a styrene-butyl acrylate resin, and the surface layer 91 comprises a styrene-polyester resin. The polymerized toner has a specific gravity of about 1.05. The particles of the polymerized toner have a three-layer structure in order to obtain the effect of preventing an offset at the fixation step by containing the wax in the core 93 and to improve the electrification efficiency of the toner by forming the surface resin layer 91. When this polymerized toner is used, oil-treated silica is externally added for the purpose of stabilizing triboelectrification charges.

In general, illustrative examples of a method for producing the spherical toner include a so-called pulverization method in which the toner is obtained by dispersing a resin, a releasing agent comprising a low-softening-point substance (wax), a coloring agent, a charge controlling agent and the like uniformly by using a pressurized-kneader, an extruder or a media dispersing device, causing the mixture to collide against a target mechanically or under a jet stream to pulverize it to desired toner particle diameters, and then subjecting the resulting mixture to a classification step to sharpen particle size distribution; a method as disclosed in Japanese Patent Post-Examined Publication No. 56-13954 in which the spherical toner is obtained by spraying a molten mixture into the air by means of a disk or a multi-hydraulic nozzle; a polymerization method disclosed in Japanese Patent Post-Examined Publication No. 36-10231 and Japanese Patent Application Laid-Open Nos. 59-53856 and 59-61842 in which the toner is directly produced by suspension polymerization; and an emulsion polymerization method typified by a soap-free polymerization method, in which the toner is directly produced by using a water-based organic solvent in which monomers are soluble but the obtained polymer is insoluble.

In the present embodiment, the sharp melt toner is produced by using a suspension polymerization method, by which fine particles having sharp particle size distribution and a particle diameter of 4 to 8 $\mu$m can be obtained relatively easily, under normal or higher pressure. Colored suspended particles having a weight average particle diameter of 7 $\mu$m, in other words, sharp melt toner was obtained by mixing styrene and n-butyl acrylate as monomers, a salicylic acid metal compound as a charge controlling agent and a saturated polyester as a polar resin together and adding a coloring agent thereto. The particle size distribution and particle diameter of the toner can be controlled by a method of changing the type and amount of a hardly water-soluble inorganic salt or a dispersing agent having a protective colloidal effect or by controlling the mechanical conditions of the apparatus such as the circumferential velocities of the rollers, the number of passes, agitation conditions such as the shapes of agitation blades, the shape of a container, the solid content in an aqueous solution or the like, so that the predetermined toner in the present embodiment can be obtained.

As a binding resin used in the toner, generally used styrene-(meth)acrylate copolymer, polyester resin, epoxy resin and styrene-butadiene copolymer can be used.

In the polymerization method for directly producing the toner, the monomers of the above resins are preferably used. Specifically, styrene-based monomers such as o-, m- or p-methylstyrene and m- or p-ethylstyrene; (meth)acrylate-based monomers such as methyl (meth)acrylate, ethyl (meth)acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, dimethylaminoethyl (meth)acrylate and diethylaminoethyl (meth)acrylate; and ester-based monomers such as butadiene, isoprene, cyclohexene, (meth)acrylonitrile and acrylic acid amide are preferably used.

These monomers are used solely or, generally, in admixture as appropriate so that the theoretical glass transition temperature (Tg) described in "POLYMER HANDBOOK, the second edition III, pp. 139 to 192 (John Wiley & Sons)" should be 40 to 75° C. When the theoretical glass transition temperature of the monomer mixture is lower than 40° C., problems occur with regard to the storage stability and endurance stability of the toner. On the other hand, when it is higher than 75° C., the fixation temperature increases, and in the case of full-color toner in particular, it lacks color reproducibility due to insufficient color mixing of toners of different colors, and further, the transparency of a transparent image is significantly degraded, so that a high-quality color image cannot be obtained.

The molecular weight of the binding resin is measured by GPC (gel permeation chromatography). To measure the molecular weight, the toner is extracted from toluene as a solvent for 20 hours by using a soxhlet extractor, the toluene is then distilled out by a rotary evaporator, an organic solvent such as chloroform which dissolves not the binding resin but ester-based wax is added to the residue to fully wash it, the resulting residue is dissolved in THF (tetrahydrofuran), and the resulting solution is then filtered by a solvent-resistant membrane filter having a pore diameter of 0.3 $\mu$m to prepare a sample (solution). After COLUMNS A-801, 802, 803, 804, 805, 806 and 807 of SHOWA DENKO K. K. are connected to GPC (model 150C) of Waters Co., Ltd., the obtained sample solution is added thereto, and the molecular weight of the binding resin is measured by the calibration curve of a standard polystyrene resin and its molecular weight distribution is determined.

The number average molecular weight Mn of the binding resin is preferably 5,000 to 1,000,000 and the ratio Mw/Mn of its weight average molecular weight Mw to the number average molecular weight Mn is preferably 2,100 as a binding resin in the toner of the present embodiment. The molecular weight of the wax is smaller than that of the binding resin and should be about several thousands to several millions in terms of number average molecular weight.

The coloring agents used in the toner are as follows. As a black coloring agent, a carbon black, a magnetic substance as well as a black mixture of yellow, magenta and cyan coloring agents are used.

As a yellow coloring agent, compounds typified by condensation azo compounds, ioindolinone compounds, anthraquinone compounds, azo metal complexes, methine compounds and allylamide compounds are used. Specifically, C.I. PIGMENT YELLOW 12, 13, 14, 15, 17, 62, 74, 83, 93, 94, 95, 97, 109, 110, 111, 120, 127, 128, 129, 147, 168, 174, 176, 180, 181, 191 and the like are suitably used.

As a magenta coloring agent, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Specifically, C.I. PIGMENT RED 2, 3, 5, 6, 7, 23, 48;2, 48;3, 48;4, 57;1, 81;1, 144, 146, 166, 169, 177, 184, 185, 202, 220, 221 and 254 are particularly preferred.

As a cyan coloring agent, phthalocyanine steel compounds and derivatives thereof, anthraquinone compounds, basic dye lake compounds and the like can be used. C.I. PIGMENT BLUE 1, 7, 15, 15;1, 15;2, 15;3, 15;4, 60, 62, 66 and the like can be particularly suitably used.

These coloring agents are used solely or in admixture and can be used in a state of solid solution. The coloring agents are selected in consideration of hue angle, saturation, lightness, weather resistance, transparency and dispersibility into the toner. The coloring agents are added in an amount of 1 to 20 parts by weight based on 100 parts by weight of the resin. When a magnetic substance is used as the black coloring agent, unlike other coloring agents, it is added in an amount of 40 to 150 parts by weight based on 100 parts by weight of the resin.

In the above description, although the case where all the four colors, i.e., yellow, magenta, cyan and black, of toners are polymerized toners has been described, it is also acceptable that polymerized toners are used for yellow, magenta and cyan and a one-component magnetic developer prepared by the pulverization method is used for black.

Next, a description will be given to the fixing apparatus 10 according to the present embodiment.

The fixing apparatus 10 comprises a fixing roller 1 as a fixing member, a pressing roller 2 as a pressing member and heating means (not shown).

The fixing roller 1 is formed by forming a releasing layer on the surface of a core bar as a supporting material whose perimeter has rigidity.

Next, a description will be given to the cases where the fixing roller to be provided in the fixing apparatus 10 has the constitutions of Examples 1 to 4 shown in Table 1 in comparison with the cases where the fixing roller has the constitutions of Comparative Examples 1 to 3. The constitution of the fixing apparatus is the same throughout Examples and Comparative Examples except for the constitutions of the fixing roller shown in Table 1.

TABLE 1

| | Ex. 1 | Ex. 2 | Ex. 3 | Ex. 4 | Ex. 5 | Ex. 6 | Comp. Ex. 1 | Comp. Ex. 2 | Comp. Ex. 3 | Comp. Ex. 4 |
|---|---|---|---|---|---|---|---|---|---|---|
| Core bar | | | | | | | | | | |
| Material | A1 | A1 | A1 | A1 | A1 | Fe | A1 | A1 | A1 | A1 |
| External diameter (mm) | 32 | 32 | 32 | 32 | 32 | 32 | 32 | 32 | 32 | 32 |
| Thickness (mm) | 2 | 2 | 2 | 4 | 9 | 2 | 2 | 2 | 9 | 2 |
| Elastic layer | none | none | none | none | none | none | none | Silicone Rubber 1 mm | none | none |
| Surface layer | PTFE coat | PTFE coat | PTFE coat | PTFE coat | PTFE coat | PTFE coat | PTFE coat | PFA coat | PTFE coat | PTFE coat |
| Pressing Force (N) | 300 | 400 | 600 | 800 | 1250 | 600 | 300 | 300 | 1400 | 400 |
| Nip (mm) | 4.8 | 5.1 | 6 | 5.1 | 4 | 6 | 5.3 | 5.5 | 4.4 | 6.9 |
| Bearing (Pa × $10^5$) | 2.0 | 2.5 | 3.1 | 5.0 | 10.0 | 3.1 | 1.8 | 1.7 | 10.1 | 1.8 |

A straight fixing roller having a length of 375 mm was used.

As the surface layer of the fixing roller, a PTFE coat or PFA coat having high releasability against toner and a higher heat-resistant temperature of 250° C. is used. Further, it has been found by the studies made by the present inventors that when electric charges whose polarity is opposite to that of the toner held on the sheet are leaked on the surface releasing layer of the fixing roller, the electrostatic attraction between a recording material and the toner decreases, whereby the toner sticks to the fixing roller and soils the fixing roller. Thus, such soiling of the fixing roller can be prevented by increasing the withstand voltage of the fixing roller. As an effective method therefor, the mixing of PFA into PTFE is conceivable. In general, PTFE is often used as a surface releasing layer because it has excellent non-cohesiveness and low friction properties and has a high continuous-duty heat-resistant temperature. However, since PTFE also has high melt viscosity, the film is liable to have pinholes at the time of firing. Meanwhile, PFA has a lower melting point and lower melt viscosity than PTFE. Therefore, by mixing of PFA into PTFE, the occurrence of pinholes on the fired film can be suppressed. As a result, the withstand voltage of the film can be increased, and the soiling of the fixing roller as described above can be inhibited more effectively.

Further, there was used a pressing roller having a length of 314 mm and obtained by laminating a 5-mm-thick silicone rubber elastic layer around a solid iron core bar having an external diameter of 20 mm and covering the laminated bar with a 50-$\mu$m-thick PFA tube as a releasing layer.

As a heat source, a halogen lamp disposed in the fixing roller was used unless otherwise stated.

Further, the hardness of the pressing roller in Examples and Comparative Examples was selected such that an adequate bearing could be obtained with an adequate pressing force. The bearing is a value calculated by (pressing force (N))/(area of nip ($m^2$)).

In general, it is considered that the fixing roller of a color fixing apparatus must have moderate elasticity, and a silicone rubber layer having a thickness of not smaller than 1 mm has been conventionally formed on the fixing roller. This is because while a monochrome image is constituted by one color of toner on a sheet, a color image is constituted by four different colors of toners on a sheet, so that the unevenness of the toners on the sheet is significant and the fixing roller must fix the toners by causing the surface of the fixing roller to follow the unevenness. When a color H.T. image is actually fixed by a fixing roller having the constitution of Comparative Example 1, a myriad of particulate gloss unevennesses having a size of about 50 to 300 $\mu$m are formed on the surface of the image due to the incomplete melting of the toner. Therefore, the image cannot be practically used.

Figure 3:
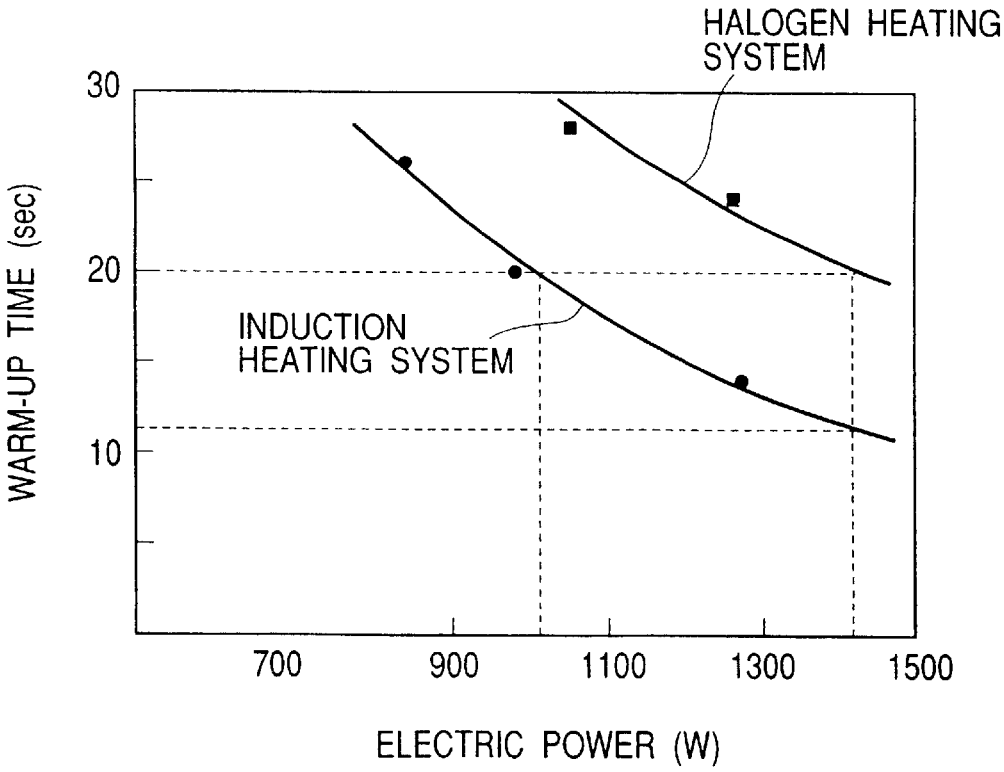
FIG. 3 is an enlarged photograph of an image with gloss unevenness which is problematic from a practical standpoint.
Figure 4:
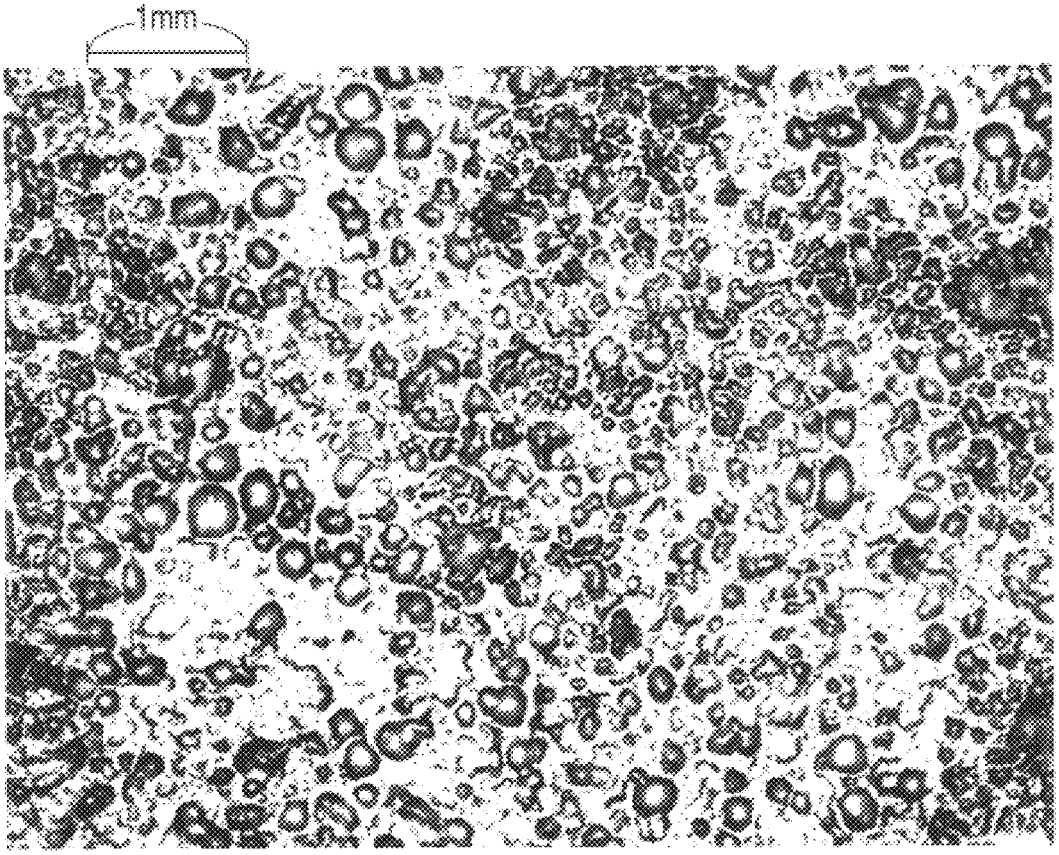
FIG. 4 is an enlarged photograph of an image with gloss unevenness which is not problematic from a practical standpoint.

FIGS. 3 and 4 are enlarged photographs of images with gloss unevenness.

In FIGS. 3 and 4, circular black portions have no gloss, while white portions have gloss. As shown in FIG. 3, when the proportion of the white portions and the proportion of the black portions are nearly the same, the gloss unevenness looks unpleasant to the eyes. On the other hand, when the proportion of the black portions is lower the proportion of the white portions as shown in FIG. 4, the gloss unevenness does not look unpleasant.

Under the circumstances, when a 1-mm-thick silicone rubber elastic layer is formed on the fixing roller as in Comparative Example 2 to increase the follow-up property of the surface of the fixing roller to the toner on a sheet, the toner can be melted uniformly and the gloss unevenness becomes negligible from a practical standpoint.

However, a soft roller having an elastic layer formed thereon has the problem that when the soft roller is used continuously at high temperatures of around 180° C., it does not last as long as a hard roller having no elastic layer because the rubber deteriorates and peels from the core bar. Further, the soft roller also has the problem that on activation of a copying machine, the soft roller takes more time for increasing the temperature of the roller to the temperature at which fixation can be carried out than the hard roller due to the presence of the elastic layer.

However, according to the studies made by the present inventors, it has been found that even a half-tone image having no gloss unevenness can be attained even by a hard roller having no elastic layer formed thereon when bearing is increased to squash polymerized toners, cause wax to come out of the toners and bind the toners together. That is, the black portions in FIGS. 3 and 4 are those where the toners are not completely bound together and fixed, while the while portions are those where the toners are bound together and completely fixed.

The results of evaluating gloss unevennesses are shown in Table 2.

TABLE 2

| | Evaluation of Gloss Unevenness |
|---|---|
| Ex. 1 | B |
| Ex. 2 | A |
| Ex. 3 | A |
| Ex. 4 | A |
| Ex. 5 | A |
| Ex. 6 | A |
| Comp. Ex. 1 | C |
| Comp. Ex. 2 | A |
| Comp. Ex. 3 | A |
| Comp. Ex. 4 | C |

In Table 2, "A" represents the level at which the gloss unevenness on the image is not noticeable, "B" represents the level at which the gloss unevenness on the image is noticeable depending on the type of sheet but is still acceptable from a practical standpoint, and "C" represents the level at which the gloss unevenness on the image is noticeable and the image cannot be practically used.

It is understood that bearing increases from Comparative Example 1, Example 1, Example 2, Example 3, Example 4 and Example 5 in the order presented and gloss unevenness reaches the level at which it is negligible from a practical standpoint when the bearing is $2.0\times10^5$ (Pa) or higher.

Further, it is also understood from the result of Comparative Example 4 that gloss unevenness is evaluated as "C" when bearing is lower than $2.0\times10^5$ (Pa) even if the nip is 6 mm as in the case of Example 3 and that gloss unevenness depends not on the size of a nip but on the level of bearing.

As for the soft roller having a rubber layer formed thereon, a nip increases in size as a pressing force is increased, a bearing of $2.0\times10^5$ (Pa) or higher is difficult to attain, and it is difficult to squash and fix polymerized toners.

Meanwhile, it is known that the movement of sheet when it passes through the fixing apparatus becomes unstable as bearing is increased and the sheet is liable to be wrinkled.

The results of evaluating the conveyances of sheets are shown in Table 3.

TABLE 3

| | Evaluation of Sheet Conveyance |
|---|---|
| Ex. 1 | A |
| Ex. 2 | A |
| Ex. 3 | A |
| Ex. 4 | A |
| Ex. 5 | B |
| Ex. 6 | A |
| Comp. Ex. 1 | A |
| Comp. Ex. 2 | A |
| Comp. Ex. 3 | C |
| Comp. Ex. 4 | A |

In Table 3, "A" represents the level at which a sheet is not wrinkled, B represents the level at which a sheet is wrinkled depending on the type of the sheet but such wrinkling is still acceptable from a practical standpoint, and "C" represents the level at which a sheet is wrinkled and such wrinkling is not negligible from a practical standpoint.

It is understood that bearing increases from Example 4, Example 5 and Comparative Example 3 in the order presented and sheet conveyance is adversely affected when the bearing exceeds $10.0\times10^5$ (Pa).

Thus, it is understood from the above description that bearing should be in the range from $3.0\times10^5$ (Pa) to $10.0\times10^5$ (Pa) (that is, $3.0\times10^5$ (Pa)$\leqq$bearing$\leqq10.0\times10^5$ (Pa)) to keep a balance between the gloss unevenness on an image and the conveyance of a sheet on a hard roller.

In Table 3, "A" represents the level at which a sheet is not wrinkled, B represents the level at which a sheet is wrinkled depending on the type of the sheet but such wrinkling is still acceptable from a practical standpoint, and "C" represents the level at which a sheet is wrinkled and such wrinkling is not negligible from a practical standpoint.

It is understood that bearing increases from Example 4, Example 5 and Comparative Example 3 in the order presented and sheet conveyance is adversely affected when the bearing exceeds $10.0\times10^5$ (Pa).

Thus, it is understood from the above description that bearing should be in the range from $3.0\times10^5$ (Pa) to $10.0\times10^5$ (Pa) (that is, $3.0\times10^5$ (Pa)$\leqq$bearing$\leqq10.0\times10^5$ (Pa)) to keep a balance between the gloss unevenness on an image and the conveyance of a sheet on a hard roller.

Figure 5:
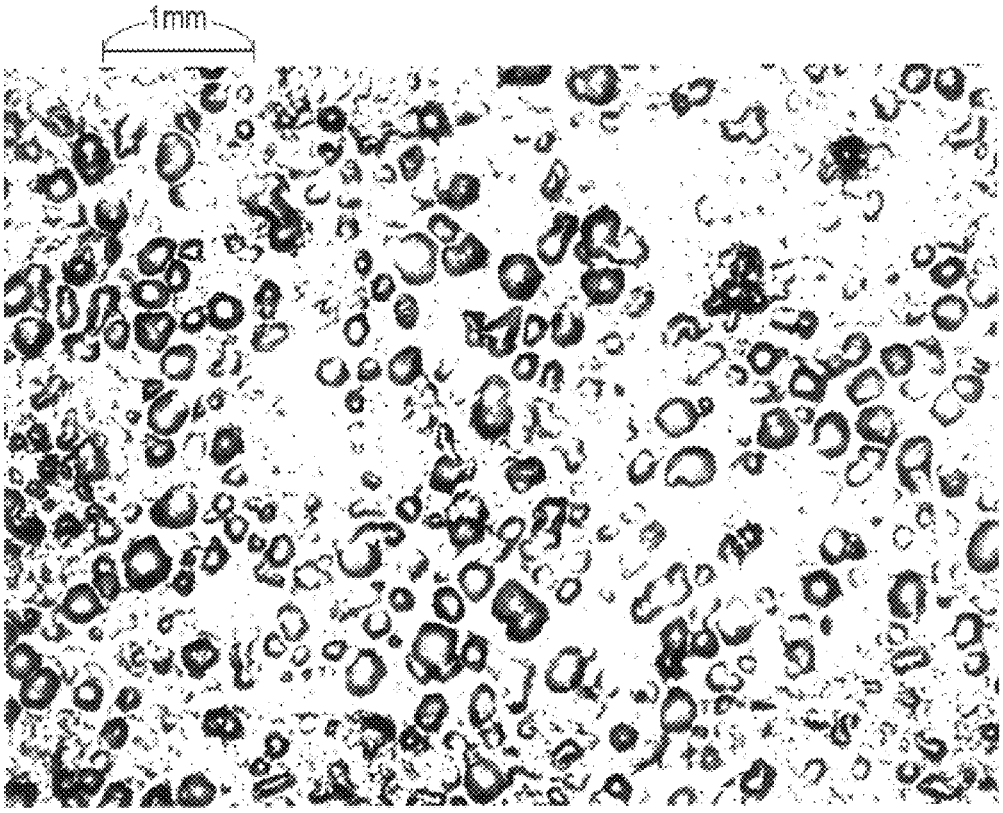
FIG. 5 is a graph showing the relationships between warm-up times and the electric powers supplied to halogen-heating and induction-heating fixing apparatuses.

Further, FIG. 5 shows a graph showing the comparison between the time spent when a fixing roller having the constitution of Example 6 is heated from room temperature to 180° C. indirectly by the radiant heat from the halogen lamp incorporated into the fixing roller (halogen heating system) and the time spent when a fixing roller having the constitution of Example 6 is heated from room temperature to 180° C. directly by the eddy current generated on the fixing roller when an alternating current is passed through the exciting coil incorporated into the fixing roller (induction heating system). The power supplied to the fixing roller is taken as the horizontal axis, while warm-up time is taken as the vertical axis.

It is understood from FIG. 3 that the induction heating system takes shorter time for heating than the halogen heating system and is therefore more advantageous for decreasing warm-up time.

Therefore, according to the present embodiment, because the fixing roller 1 whose perimeter is formed by forming the releasing layer on the surface of the core bar which has rigidity is used and the relationship between the pressing force F(N) between the fixing roller 1 and the pressing roller 2 and the area S($m^2$) of the nip between the fixing roller 1 and the pressing roller 2 is properly adjusted, an increase in the useful life of the fixing member in an oil-less fixing apparatus and decrease in warm-up time can be achieved while good fixation is secured.

Although the embodiments of the present invention have been described above, the present invention is not limited to these embodiments and any modifications can be within technical conceptions.

What is claimed is:

1. A fixing apparatus comprising:

a heat-fixing member, said heat-fixing member having a core metal and a surface releasing layer which is provided on said core metal and does not have a rubber elasticity; and a pressing member which forms a nip which holds and conveys a recording material holding an unfixed image formed of wax-containing toner, wherein the unfixed image is fixed to the recording material with heat and pressure, and the following expression is satisfied:

$$2.0\times10^5 \leqq F/S \leqq 10.0\times10^5$$

wherein F is the pressure-contact force (N) between the fixing member and the pressing member, and S is the area ($m^2$) of the nip.

2. The apparatus of claim 1, wherein the surface releasing layer comprises a fluororesin.

3. The apparatus of claim 2, wherein the surface releasing layer comprises a mixture of a polytetrafluoroethylene and a copolymer of perfluoroalkyl vinyl ether.

4. The apparatus of claim 1, wherein the toner is non-magnetic.

5. The apparatus of claim 1, wherein the toner is formed by a polymerization method.

6. The apparatus of claim 1, wherein said pressing member has a rubber layer.

7. The apparatus of claim 1, which further comprises an exciting coil through which an alternating current is passed to generate an eddy current on said fixing member so as to heat said fixing member.

8. A fixing apparatus according to claim 1, wherein said heat-fixing member is a straight type cylindrical roller.

9. A fixing apparatus according to claim 1, wherein F/S is a sufficient pressure for squashing the toner which is not fully heat-melted.

* * * * *

UNITED STATES PATENT AND TRADEMARK OFFICE

CERTIFICATE OF CORRECTION

PATENT NO. : 6,564,032 B2
DATED : May 13, 2003
INVENTOR(S) : Nobuaki Hara et al.

It is certified that error appears in the above-identified patent and that said Letters Patent is hereby corrected as shown below:

Title page,
Item [56], References Cited, FOREIGN PATENT DOCUMENTS, "36-10231 7/1936" should read -- 36-10231 7/1961 --.

Column 4,
Line 32, "tot he" should read -- to the --.

Signed and Sealed this

Thirtieth Day of December, 2003

JAMES E. ROGAN
*Director of the United States Patent and Trademark Office*